US007686206B2

(12) United States Patent
Bondarik

(10) Patent No.: US 7,686,206 B2
(45) Date of Patent: Mar. 30, 2010

(54) COLLAPSIBLE GIFT BOX

(75) Inventor: Hanna Bondarik, Middlesex, NJ (US)

(73) Assignee: Bath & Body Works Brand Management, Inc., Reynoldsburg, OH (US)

( * ) Notice: Subject to any disclaimer, the term of this patent is extended or adjusted under 35 U.S.C. 154(b) by 674 days.

(21) Appl. No.: 11/586,935

(22) Filed: Oct. 26, 2006

(65) Prior Publication Data

US 2008/0099543 A1 May 1, 2008

(51) Int. Cl.
*B65D 5/36* (2006.01)

(52) U.S. Cl. ..... 229/117.08; 229/122.32; 229/190

(58) Field of Classification Search ..... 229/117.01, 229/117.07, 117.08, 141, 122.32, 190
See application file for complete search history.

(56) References Cited

U.S. PATENT DOCUMENTS

| | | | | | |
|---|---|---|---|---|---|
| 317,795 | A | | 5/1885 | Jaeger | |
| 1,234,421 | A | * | 7/1917 | Tinsley | 206/45.22 |
| 1,337,507 | A | * | 4/1920 | De Lemos | 229/149 |
| 1,442,837 | A | * | 1/1923 | Weber | 229/149 |
| 2,089,831 | A | | 8/1937 | Henriksen | |
| 2,206,304 | A | | 7/1940 | Ringler | |
| 2,255,223 | A | | 9/1941 | Lighter | |
| 2,531,507 | A | | 11/1950 | Goodyear | |
| 2,889,103 | A | * | 6/1959 | Kuchenbecker | 229/145 |
| 3,270,939 | A | * | 9/1966 | Ebelhardt | 229/117.19 |
| 3,658,234 | A | * | 4/1972 | Deckys | 229/151 |
| 5,121,876 | A | * | 6/1992 | Johnson | 229/117.07 |
| 5,297,726 | A | | 3/1994 | Detzel | |
| 6,032,853 | A | | 3/2000 | Chevalier | |
| 6,484,931 | B1 | * | 11/2002 | Hofte | 229/149 |
| 2003/0085265 | A1 | * | 5/2003 | Haim | 229/123.1 |
| 2004/0140345 | A1 | | 7/2004 | Kao | |
| 2005/0279816 | A1 | | 12/2005 | Kao | |

FOREIGN PATENT DOCUMENTS

| | | |
|---|---|---|
| FR | 2415581 | 8/1979 |
| GB | 463482 | 3/1937 |
| GB | 533914 | 2/1941 |
| GB | 897932 | 5/1962 |
| GB | 1020879 | 2/1966 |
| GB | 2398293 | 8/2004 |

* cited by examiner

*Primary Examiner*—Gary E Elkins
*Assistant Examiner*—Christopher Demeree
(74) *Attorney, Agent, or Firm*—Ward & Olivo

(57) ABSTRACT

A collapsible box comprising a body having a front panel, a bottom panel, a back panel, a top panel, a closing panel, a left panel, a right panel, a front folding panel, and a back folding panel. Each of the front and back folding panels comprises foldably connected center panel and two side panels. The bottom panel edges are foldably connected to edges of the front, left, back, and right panels. The opposite edges of the top panel are foldably connected to the back and closing panels. The edges of the front folding panel are foldably connected to one set edges of the left and right panels, and edges of said back folding panel are foldably connected to opposite set edges of the left and right panels.

20 Claims, 6 Drawing Sheets

COLLAPSIBLE GIFT BOX

FIELD OF THE INVENTION

The present invention relates to a packaging structure. More specifically, the invention relates to a collapsible gift box comprising a plurality of independent panels.

BACKGROUND OF THE INVENTION

The use of cardboard boxes as gift boxes is well known. There are several general classes of cardboard boxes manufactured today that are used as gift boxes.

For instance, many cardboard boxes are pre-constructed by box manufacturers and are directly delivered to customers. These boxes are available for use immediately upon receipt by the customer. That is, the customer does not need to modify the cardboard box in any way. However, pre-constructed cardboard boxes require large amounts of space in order to be shipped, and are easily damaged during transit. As a result, the cost associated with shipping pre-constructed cardboard boxes is high. Similarly, pre-constructed boxes require costly storage space when they arrive at a store, further increasing the costs associated with pre-constructed cardboard boxes. Accordingly, pre-constructed cardboard boxes are economically inefficient.

In an attempt to alleviate the aforementioned problems, foldable cardboard boxes were developed. These boxes, designed as single flat sheets, improve the storage and transportation inefficiencies by reducing the overall volume of each cardboard box. In other words, a greater number of single flat sheets occupy the same volume as a pre-constructed cardboard box. However, foldable cardboard boxes must be manually constructed by folding and/or tucking various parts of the single sheet together. The time and labor costs associated with manually constructing these cardboard boxes is high. Costly adhesive may be required to ensure that the single sheet foldable box maintains an appropriate shape. Accordingly, single sheet foldable cardboard boxes are economically inefficient. Further, the constant folding of a single foldable cardboard box along the proper line weakens the structural integrity of the resulting cardboard box. As a result, foldable boxes are generally not as sturdy as pre-constructed cardboard boxes.

Foldable cardboard boxes can also be constructed from a plurality of cardboard sheets. This type of collapsible box is comprised of a plurality of separate cardboard sheets for each wall of the box (e.g., top, bottom, and sides). Typically, the cardboard sheets are attached to each other via a decorative layer such as felt. This type of foldable box is much sturdier than a single sheet foldable box because it is comprised of separate cardboard sheets. However, the current box configurations provide rough surfaces and cluttered folding lines.

Thus, it would be advantageous to have a foldable cardboard box which is constructed of a plurality of cardboard sheets, which is relatively inexpensive, and which has aesthetically clean folding lines. This provides a plain interior surface which provides more volume and prevents items placed inside from snagging and ruining the box. The present invention is such an article.

SUMMARY OF THE INVENTION

The present invention provides a collapsible box comprising a body having a front panel, a bottom panel, a back panel, a top panel, a closing panel, a left panel, a right panel, a front folding panel, and a back folding panel. Each front and back folding panel comprises a foldably connected center panel and two side panels. Edges of the bottom panel are foldably connected to edges of the front, left, back, and right panels. The opposite edges of the top panel are foldably connected to the back and closing panels. The edges of the front folding panel are foldably connected to one set edges of the left and right panels, and edges of the back folding panel are foldably connected to opposing set edges of the left and right panels. The front, left, back, right, bottom, and top panels form exterior surface collapsible box walls, while the front folding panel, back folding panel, left panel, right panel, bottom panel, and top panel form interior surface box walls. As described in greater detail below, the folding panels allow the box to be folded from a flat position.

To collapse the box, the front two side panels fold with respect to the front center panel and the back two side panels fold with respect to the back center panel. Conversely, to erect the box the front two side panels unfold with respect to the front center panel and the back two side panels unfold with respect to the back center panel.

Further, the front center panel can be permanently attached to the front panel and the back center panel can be permanently attached to the back panel. This allows the user to easily pull apart or push together the front and back panels to collapse or erect the box.

To close the erect box, the closing panel and the front panel may include attachment means such as, but not limited to, removable adhesives, permanent adhesives, glue, magnets, Velcro™, rivets, pins, clasps, or the like. The collapsible box may further comprise additional attachment means to attach the front two side panels to the front panel and the back two side panels to the back panel to maintain the box in an erect position.

The box panels may be constructed of a rigid layer laminated in flexible sheets of material. The folding lines connecting the panels are formed by spacing apart the rigid layers such that the folding lines only consist of flexible sheets. The rigid layer can consist of cardboard, plastic, wood, metal, composite material, or the like. The flexible layers comprise sturdy material that can sustain continuous folding and unfolding. For example, the flexible layer can consist of paper, plastic, felt, decorative paper, composite material, or the like.

The collapsible box may include additional decorative features including, but not limited to: transparent windows, handles, bows, tassels, mirrors, locks, dividers, or the like.

In light of the foregoing, it is an object of the present invention to provide an improved collapsible box.

Another object of the present invention is to provide a collapsible box comprising a plurality of independent panels.

Another object of the present invention is to provide a collapsible box comprising aesthetically clean folding lines.

Yet another object of the present invention is to provide a collapsible box with a plain interior surface.

Another object of the present invention is to provide a collapsible box with a large inner volume.

Another object of the present invention is to provide a collapsible box which is easily assembled.

Still another object of the present invention is to provide a collapsible box which is easily collapsed.

A further object of the present invention is to provide a collapsible box which is easily erected.

Yet a further object of the present invention is to provide a collapsible box with a sturdy configuration.

BRIEF DESCRIPTION OF THE DRAWINGS

A further understanding of the present invention can be obtained by reference to preferred embodiments and corresponding alternate embodiments as set forth in the illustrations of the accompanying drawings. Although the illustrated embodiments are merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the specific methods and instrumentalities disclosed.

For a more complete understanding of the present invention, reference is now made to the following drawings in which.

DETAILED DESCRIPTION OF THE PREFERRED EMBODIMENT

Figure 1:
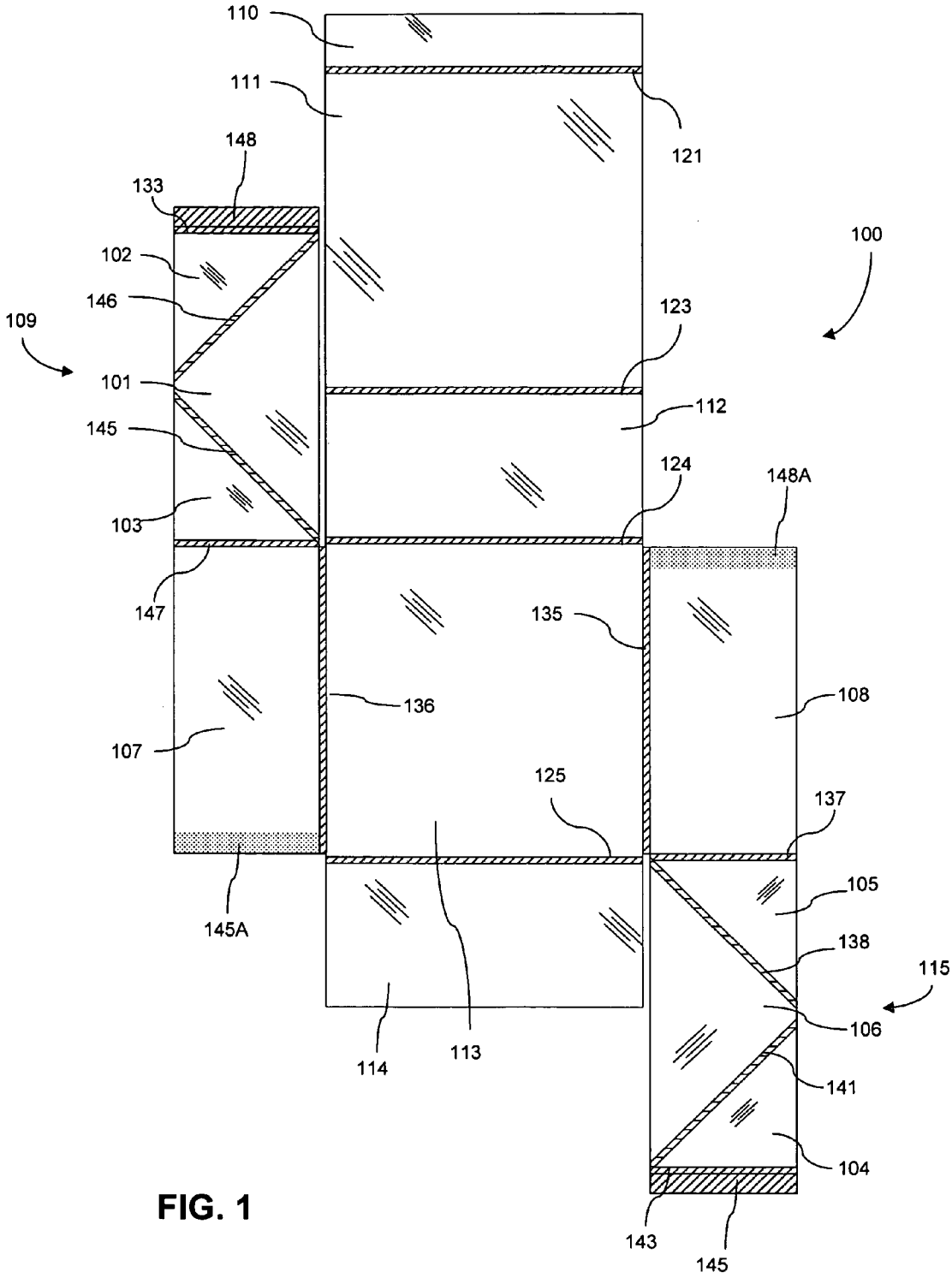
FIG. 1 illustrates a pane top view of a collapsible box body, in accordance with the present invention.
Figure 2:
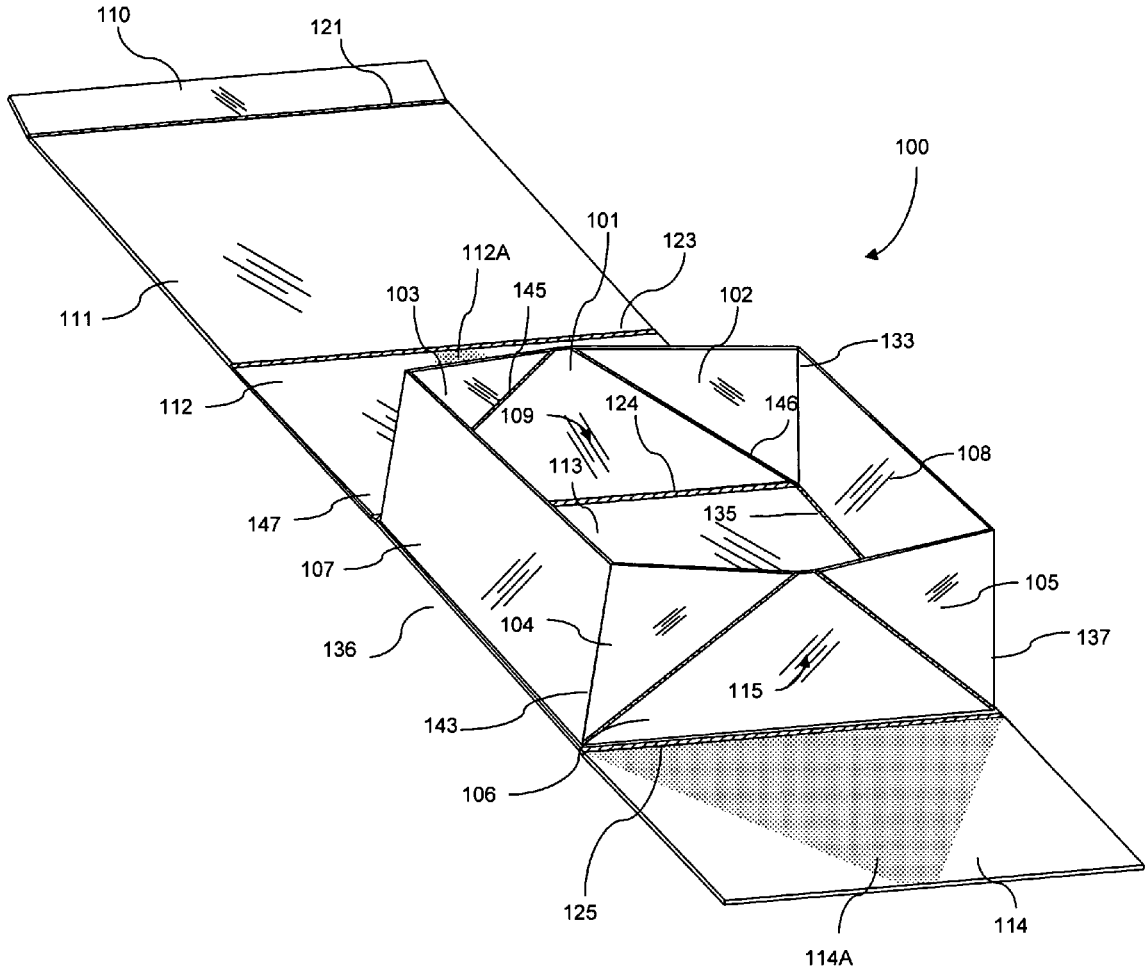
FIG. 2 illustrates a perspective view of an assembled collapsible box, in accordance with the present invention.

A detailed illustrative embodiment of the present invention is disclosed herein. However, the present invention may be embodied in a wide variety of forms, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

Moreover, well known methods and procedures for both carrying out the objectives of the present invention and illustrating the preferred embodiment are incorporated herein by reference but have not been described in detail as not to unnecessarily obscure aspects of the present invention.

Referring to the drawings wherein like numerals indicate like elements throughout, FIGS. 1-6 show a collapsible box 100. The box may comprise various materials known to one skilled in the art. However, durable materials and configurations are preferred which allow continuous folding and unfolding of the box without causing damage. In accordance with the preferred embodiment of the present invention, the box comprises plurality of panels made from a rigid layer laminated between flexible layers. As such, each panel comprises a rigid inner layer and at least one flexible layer on each opposing surface. The panels are attached along their edges via foldable connections. The foldable connections are formed by spacing apart the rigid layers of the panels such that the connections only comprise flexible layers (i.e., absent the rigid layer). As the flexible layers will experience wear from folding and unfolding the box, durable materials are preferred. The flexible layers may comprise durable paper, plastic, felt, decorative paper, composite material, or the like. The rigid layer may comprise cardboard, plastic, wood, metal, composite material, or the like.

During the manufacturing process, the rigid layers of the box panels are laid flat with respect to each other, as depicted in FIG. 1. The chosen spacing is determined by the desired folding angled of the neighboring panels (e.g., 90°, 180°, etc.). The panels are then laminated with at least one sheet of flexible layer on the upper surface and at lest one sheet of flexible layer on the bottom surface. Alternatively, the box body may be laminated in sections leaving flexible flaps on the panel edges to interconnect the sections. After the box body is laminated, the remaining material is cut to size and the box edges are finished, as is well known in the art.

In accordance with the present invention, box 100 comprises bottom panel 113, front panel 114, back panel 112, top panel 111, left panel 107, right panel 108, closing panel 110, front folding panel 115, and back folding panel 109. Front and back folding panels 115 and 109 are actively folded and unfolded to erect and collapse box 100. Specifically, each front and back folding panel 115 and 109 is divided into three sections comprising center panels 106 and 101 and two side panels 104-105 and 102-103, respectfully. Front and back side panels 102-105 are 45°/45°/90° triangles that span the two upper corners of front and back folding panels 115 and 109. Front and back center panels 106 and 101 are the remainder center sections of the folding panels 115 and 109 that form larger 45°/45°/90° triangles, but form 45°/45°/135°/135° trapezoids as the width of front and back folding panels 115 and 109 increases. Front side panels 102-103 are diagonally connected along folding connections 138 and 141 to front center panel 106 and the back side panels 102-103 are diagonally connected along folding connections 145-146 to back center panel 101.

The outer edges of bottom panel 113 are foldably connected to the edges of front panel 114, left panel 107, back panel 112, and right panel 108 via foldable connections 125, 136, 124, and 135 respectfully. The opposing outer edges of top panel 111 are foldably connected to the edges of back panel 112 and closing panel 110 via foldable connections 123 and 121, respectfully. One side edge of right panel 108, orthogonal to the edge connected to bottom panel 113, is connected to one side edge of front folding panel 115 along foldable connection 137. Similarly, one side edge of left panel 107, orthogonal to the edge connected to bottom panel 113, is connected to one side edge of back folding panel 109 along foldable connection 147. The second side edges of front and back folding panels 115 and 109 are connected to connecting flaps 145 and 148 along folding lines 143 and 133. Preferably, connecting flaps 145 and 148 are made of at lest two flexible layers.

To assemble collapsible box 100, left and right panels 107 and 108 are folded orthogonally with respect to bottom panel 113 along lines 136 and 135. Front folding panel 115 is folded orthogonally with respect to right panel 108 along line 137 and placed parallel to front panel 114. In addition, back folding panel 109 is folded orthogonally with respect to left panel 107 along line 147 and placed parallel to back panel 112. Connecting flap 145 is permanently adhered to area 145A of left panel 107 to connect the second side edge of front folding panel 115 to the second side edge of left panel 107. Likewise, connecting flap 148 is permanently adhered to area 148A of right panel 108 to connect the second side edge of back folding panel 109 to the second side edge of right panel 108. This positions collapsible box 100 to an erect position illustrated in FIG. 2. Connecting flaps 145 and 148 can adhere to the surface of area 148A and 145A or alternatively, connecting flaps 145 and 148 can be inserted between the flexible layer and rigid layer of the panel to provide a better finished product. It is also understood by one ordinary skilled in the art that any other method of assembling the panels of box 100 to an erect position of FIG. 2 can be utilized without departing from the scope of the present invention.

Figure 3:
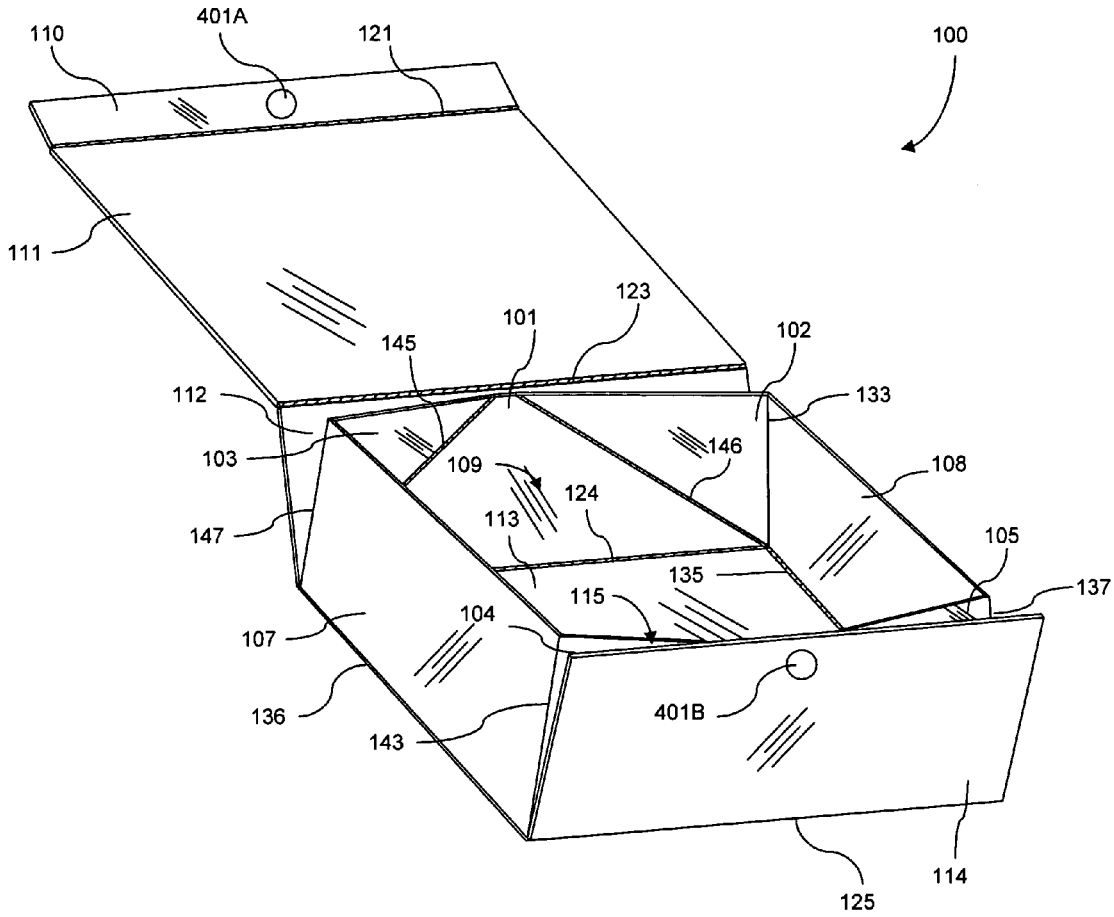
FIG. 3 illustrates a perspective view of a collapsible box in an erect position, in accordance with the present invention.

To enhance the ease of erecting and collapsing box 100, front and back panels 114 and 112 can be folded orthogonally in relation to bottom panel 113 along folding connections 125 and 124. Front center panel 106 is permanently adhered to area 114A of front panel 114 and back center panel 101 is permanently adhered to area 112A of back panel 112, as illustrated in FIG. 3. The fully erect collapsible box in FIG. 3 comprises interior surface walls defined by bottom panel 113, left panel 107, right panel 108, front folding panel 115, back folding panel 109, and top panel 111. The interior surface is further defined by corners along folding connections 133, 137, 143, and 147. Advantageously, the aesthetic interior surface of the present box configuration consists of plain wall surfaces which prevent precluding objects from getting snagged on the interior walls of the box.

Figure 4:
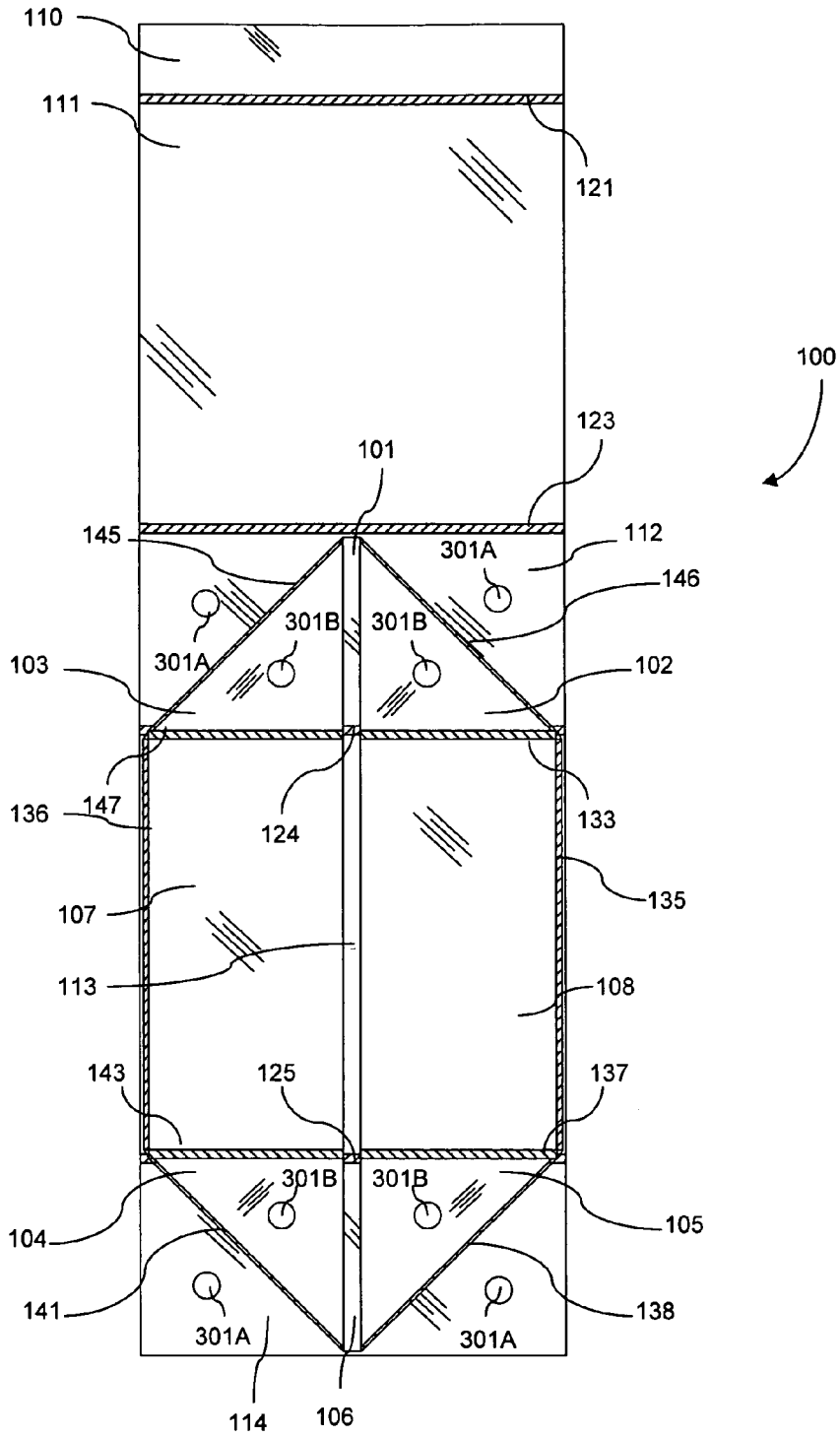
FIG. 4 illustrates a pane top view of a collapsible box when in a collapsed position, in accordance with the present invention.
Figure 5:
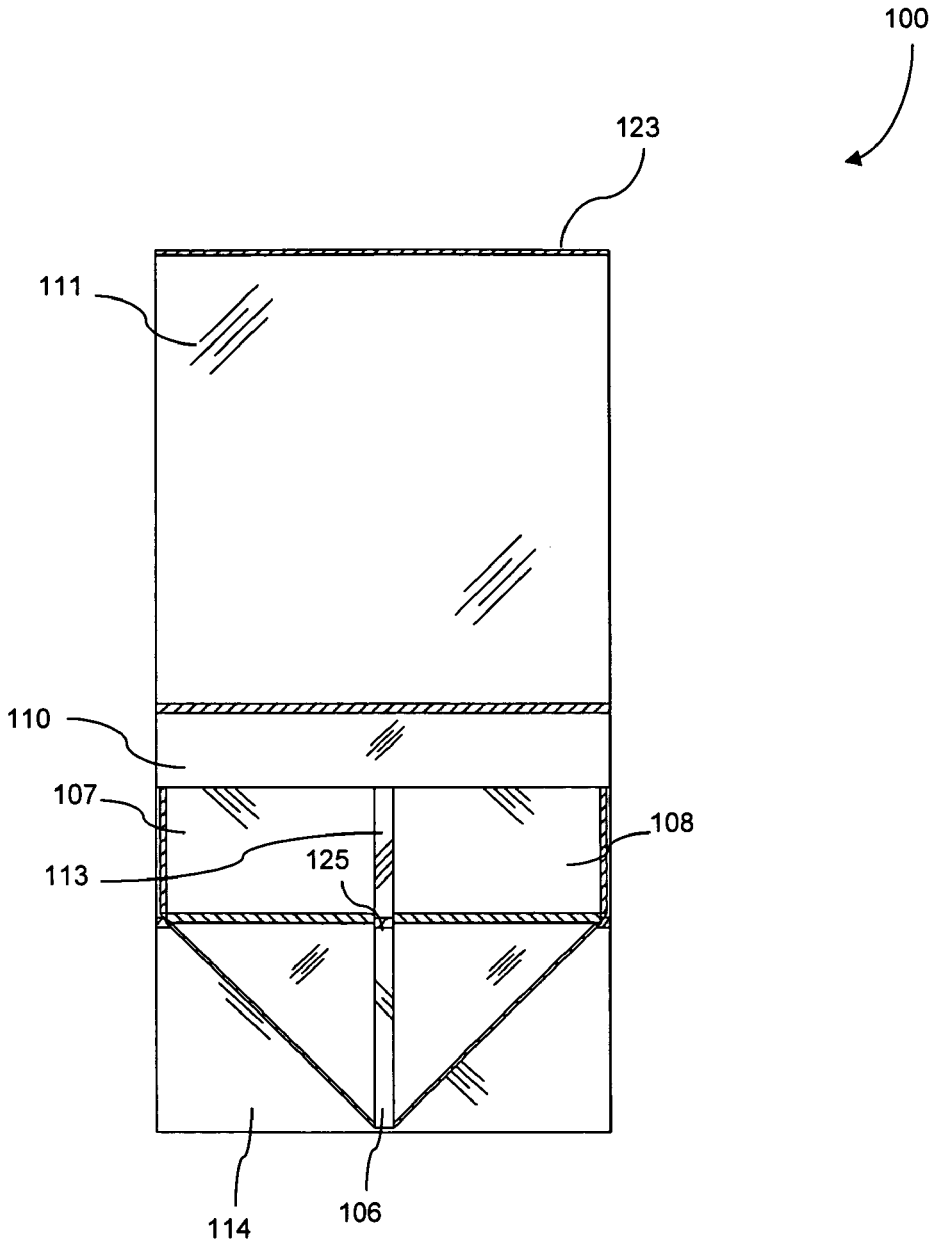
FIG. 5 illustrates a pane top view of a collapsible box in a smaller collapsed position, in accordance with the present invention.

The box is collapsed by unfolding front and back panels 114 and 112 along lines 125 and 124, thereby pulling front and back center panels 106 and 101 flat with respect to bottom panel 113 to the collapsed position shown in FIG. 4. This causes front side panels 104-105 to fold with respect to front center panel 106 along lines 138 and 141 and back two side panels 102-103 to fold with respect to back center panel 101 along lines 145 and 146. To further collapse the box into a smaller configuration, top panel 111 can be folded with respect to back panel 112 along line 123 as illustrated in FIG. 5. To even further collapse the box, front panel 114 may be folded with respect to bottom panel 113 along line 125 (not shown). As such, the box provides a small collapsed configuration which is easy to ship and store.

Figure 6:
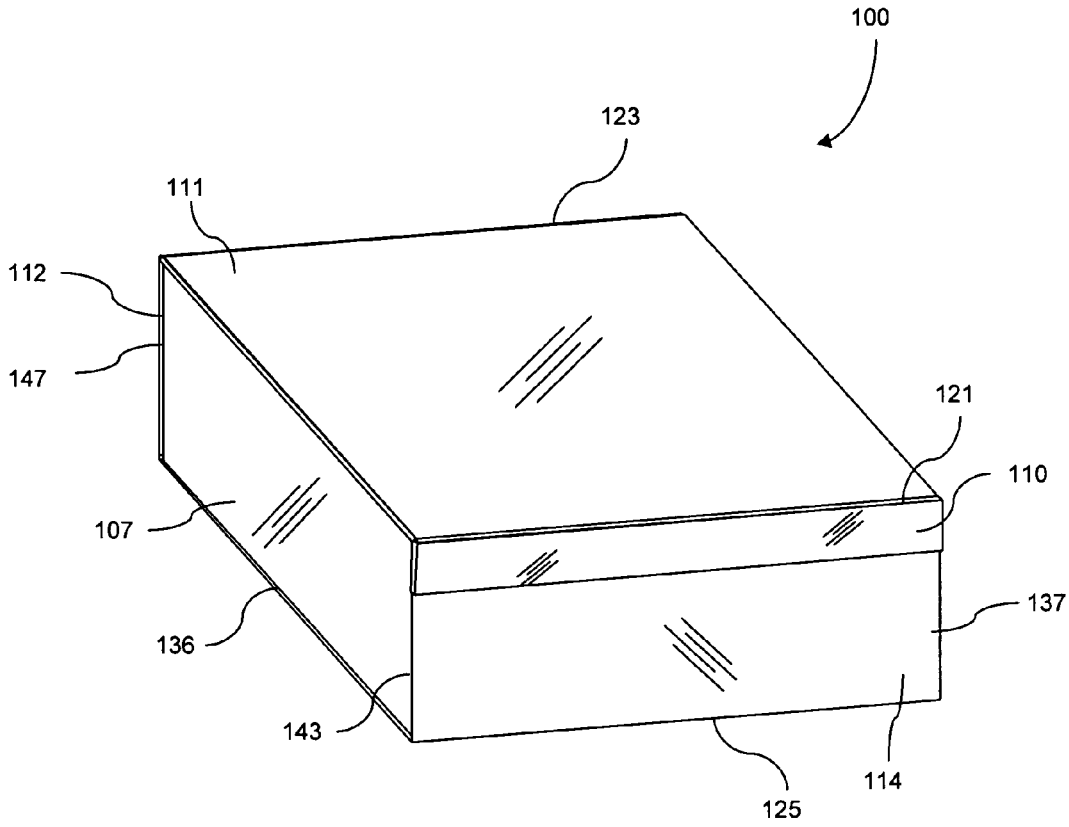
FIG. 6 illustrates a perspective view of a collapsible box in an erect and closed position, in accordance with the present invention.

To erect the box from the collapsed position shown in FIG. 5, top panel 111 is unfolded with respect to bottom panel 113 along line 123 to the position shown in FIG. 4. Front and back panels 114 and 112 are folded orthogonally with respect to bottom panel 113. Front two side panels 104-105 are unfolded with respect to front center panel 106 along line 138 and 141 and back two side panels 102-103 are unfolded with respect to back center panel 101 along lines 146 and 145 to the erect position shown in FIG. 3. The box is closed by folding top panel 111 with respect to bottom panel 113 along line 123 and folding closing panel 110 along line 121 as illustrated in FIG. 6. The closed collapsible box 100 comprises exterior surface walls defined by front panel 114, left panel 107, back panel 112, right panel 108, bottom panel 113, and top panel 111. The exterior surface is further defined by corners along folding connections 133, 137, 143, and 147.

The collapsible box of the present invention can further comprise attachment means to attach various panels to one another. The utilized attachment means can include: removable adhesives, permanent adhesives, glue, magnets, Velcro™, rivets, pins, clasps, or the like. For example, as illustrated in FIG. 3, magnets 401A and 401B can be included to attach closing panel 110 to front panel 114 so that box 100 can be maintained in the closed position of FIG. 6. Additionally, as illustrated in FIG. 4, Velcro™ pieces of hook parts 301A and loop parts 301B, or vice versa, can be incorporated into front and back panels 114 and 112 and front and back two side panels 102-105. In an erect position (FIG. 3), hook parts 301A will connect to loop parts 301B to attach front two side panels 104-105 to front panel 114 and back two side panels 102-103 to back panel 112 to maintain the box in an erect position. Temporary attachment means allow the box to be folded and unfolded as needed. However, permanent attachment means can also be utilized if it is desired for the box to stay in one configuration. For example, instead of the Velcro™ pieces or magnets glue can be used covered with a removable film. When the box is ready to be placed in a desired position, the film is removed to expose the glue to adhere the desired panels in place. Although circular attachment means are illustrated, it is obvious to one skilled in the art that any other shapes of attachments means can be utilized without departing from the scope of the present invention including, but not limited to strips, triangles, squares, rectangles, or the like.

Additionally, the attachment means can span the entire surface of the panel. For instance, the entire surface of closing flap 110 can be covered with glue (not shown) with a removable film that is removed to adhere closing flap 110 to front panel 114.

Other decorative features (not shown) can be incorporated into the box design. As an example, a transparent window can be placed in the center of closing panel 111 which allows a user to see the internal contents of box 100. Handles can be incorporated on the exterior surface of left and right panels 107 and 108 that allow a user to lift box 100. Other features can include, but are not limited to: bows, tassels, mirrors, locks, dividers, or the like.

From the foregoing description of the preferred embodiment, which has been set forth in considerable detail for the purpose of making a complete disclosure of the present invention, it can be seen that the present invention comprises a collapsible box. Specifically, the collapsible box comprises a body having a front panel, a bottom panel, a back panel, a top panel, a closing panel, a left panel, a right panel, a front folding panel, and a back folding panel. Each of the front and back folding panels comprises foldably connected center panel and two side panels. The bottom panel edges are foldably connected to edges of the front, left, back, and right panels. The opposite edges of the top panel are foldably connected to the back and closing panels. The edges of the front folding panel are foldably connected to one set edges of the left and right panels, and edges of the back folding panel are foldably connected to opposite set edges of the left and right panels. It will be appreciated by those skilled in the art that changes can be made to the embodiment described above without departing from the broad inventive concept thereof. It is understood, therefore, that this invention is not limited to the particular embodiment disclosed, but it is intended to cover all modifications that are within the scope and spirit of the invention as defined by the appended claims.

What is claimed is:

1. A collapsible box comprising:

a body having a front panel, a bottom panel, a back panel, a top panel, a closing panel, a left panel, and a right panel;

a front folding panel connected to said right panel along a first common edge, and also connected to said left panel along a second common edge, wherein said front folding panel further comprises a first center panel and a plurality of first side panels, wherein said first center panel includes a plurality of third and fourth common edges with said plurality of first side panels for collapsing said front folding panel;

a back folding panel connected to said left panel along a fifth common edge, and also connected to said right panel along a sixth common edge, wherein said back folding panel further comprises a second center panel and a plurality of second side panels, wherein said second center panel has a plurality of seventh and eighth common edges with said plurality of second side panels for collapsing said back folding panel, wherein said closing panel is connected to said top panel along a ninth common edge;

wherein each of said left, right, front folding, back folding, bottom, and top panels are connected together to enclose an interior space of said body;

wherein edges of said bottom panel are foldably connected to edges of said front, left. back, and right panels, wherein said top panel is foldably connected to said back panel at a bottom edge of said top panel and also foldably connected to said closing panel at said top edge of said top panel, wherein said first center panel is permanently connected to an interior surface of said front panel for causing said front panel to be collapsed along said plurality of third and fourth common edges, and further wherein said second center panel is permanently connected to an interior surface of said back panel for causing said back panel to be collapsed along said plurality of seventh and eighth common edges, wherein collapsing said front panel away from said back panel causes said collapsible box to be collapsed in one motion.

2. A collapsible box according to claim 1 wherein said front, left, back, right, bottom, and top panels form exterior surface walls of said box.

3. A collapsible box according to claim 1 wherein said front folding panel, back folding panel, left panel, right panel, bottom panel, and top panel form interior surface walls of said box.

4. A collapsible box according to claim 1 wherein said front two side panels fold with respect to said front center panel and said back two side panels fold with respect to said back center panel to collapse said box.

5. A collapsible box according to claim 1 wherein said front two side panels unfold with respect to said front center panel and said back two side panels unfold with respect to said back center panel to erect said box.

6. A collapsible box according to claim 1 wherein said front center panel is permanently attached to said front panel and said back center panel is permanently attached to said back panel.

7. A collapsible box according to claim 1 further comprises attachment means to attach said closing panel to said front panel to close said box.

8. A collapsible box according to claim 7 wherein said attachment means is at least one selected from a group consisting of removable adhesives, permanent adhesives, glue, magnets, hook and loop connection, rivets, pins, and clasps.

9. A collapsible box according to claim 1 further comprises attachment means to attach said front two side panels to said front panel and said back two side panels to said back panel to maintain said box in an erect position.

10. A collapsible box according to claim 9 wherein said attachment means is at least one selected from a group consisting of removable adhesives, permanent adhesives, glue, magnets, hook and loop connection, rivets, pins, and clasps.

11. A collapsible box according to claim 9 wherein said rigid layer is at least one selected from a group consisting of cardboard, plastic, wood, metal, and composite material.

12. A collapsible box according to claim 11 wherein said rigid layer is laminated with at least one flexible layer.

13. A collapsible box according to claim 12 wherein said at least one flexible layer is at least one selected from a group consisting of paper, plastic, felt, decorative paper, and composite material.

14. A collapsible box according to claim 1 wherein said body panels comprise a rigid layer.

15. A collapsible box according to claim 1 wherein said foldable connections comprise at least one flexible layer capable of folding.

16. A collapsible box according to claim 15 wherein said at least one flexible layer is at least one selected from a group consisting of paper, plastic, felt, decorative paper, and composite material.

17. A collapsible box according to claim 1 wherein said top panel comprises a transparent window.

18. A collapsible box according to claim 1 wherein said left and right panels comprise handles.

19. A collapsible box comprising:

a body having a front panel, a bottom panel, a back panel, a top panel, a closing panel, a left panel, a right panel, a front folding panel, and a back folding panel, wherein said front folding panel is connected to said right panel along a first common edge, and also connected to said left panel along a second common edge, wherein said front folding panel further comprises a first center panel and a plurality of first and second side panels, wherein said first center panel shares a plurality of third and fourth common edges with said plurality of first side panels for collapsing said front folding panel, and further wherein said back folding panel is connected to said left panel along a fifth common edge, and also connected to said right panel along a sixth common edge, wherein said back folding panel further comprises a second center panel and a plurality of third, and fourth side panels, wherein said second center panel shares a plurality of seventh and eighth common edges with said plurality of second side panels for collapsing said back folding panel;

wherein edges of said bottom panel are foldably connected to edges of said front, left, back, and right panels;

wherein opposite edges of said top panel are foldably connected to said back and closing panels;

wherein edges of said front folding panel are foldably connected to one set edges of said left and right panels, and edges of said back folding panel are foldably connected to opposite set edges of said left and right panels; and wherein said first center panel is permanently connected to an interior surface of said front panel for causing said front panel to be collapsed along said plurality of third and fourth common edges, and further wherein second center panel is permanently connected to an interior surface of said back panel for causing said back panel to be collapsed along said plurality of seventh and eighth common edges, wherein collapsing said front panel away from said back panel causes said collapsible box to be collapsed in one motion.

20. A collapsible box comprising:

a body having a front panel, a bottom panel, a back panel, a top panel, a closing panel, a left panel, and a right panel;

a front folding panel connected to said right panel, and also connected to said left panel, wherein said front folding panel further comprises a first center panel and a plurality of first side panels, wherein said first center panel having a plurality of first and second common edges with said plurality of first side panels for facilitating collapsing said front folding panel;

a back folding panel connected to said left panel, and also connected to said right panel, wherein said back folding panel further comprises a second center panel and a plurality of second side panels, wherein said second center panel having a plurality of third and fourth common edges with said plurality of second side panels for facilitating collapsing said back folding panel;

a first attachment means to attach said closing panel to said front panel; and a second attachment means to attach said plurality of first side panels to said front panel and said plurality of second side panels to said back panel;

wherein edges of said bottom panel are foldably connected to edges of said front, left, back, and right panels;

wherein opposite edges of said top panel are foldably connected to said back and closing panels;

wherein edges of said front folding panel are foldably connected to one set edges of said left and right panels, and edges of said back folding panel are foldably connected to opposite set edges of said left and right panels; and wherein said first center panel is permanently attached to said front panel and said second center panel is permanently attached to said back panel, wherein collapsing said front panel away from said back panel causes said collapsible box to be collapsed in one motion.

* * * * *